US006675144B1

(12) United States Patent
Tucker et al.

(10) Patent No.: US 6,675,144 B1
(45) Date of Patent: Jan. 6, 2004

(54) AUDIO CODING SYSTEMS AND METHODS

(75) Inventors: Roger Cecil Ferry Tucker, Monmouthshire (GB); Carl William Seymour, London (GB); Anthony John Robinson, Cambridge (GB)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/423,758

(22) PCT Filed: May 15, 1998

(86) PCT No.: PCT/GB98/01414

§ 371 (c)(1),
(2), (4) Date: Feb. 16, 2000

(87) PCT Pub. No.: WO98/52187

PCT Pub. Date: Nov. 19, 1998

(30) Foreign Application Priority Data

May 15, 1997 (EP) ..... 97303321

(51) Int. Cl.[7] ..... G10L 13/02
(52) U.S. Cl. ..... 704/264; 704/219
(58) Field of Search ..... 704/264, 219, 704/200

(56) References Cited

U.S. PATENT DOCUMENTS 4,813,076 A * 3/1989 Miller ..... 704/203
5,001,758 A * 3/1991 Galand et al. ..... 704/203
5,321,793 A * 6/1994 Drogo De Iacovo et al. ..... 704/220
5,473,727 A * 12/1995 Nishiguchi et al. ..... 704/222
5,579,434 A * 11/1996 Kudo et al. ..... 704/219
5,632,002 A * 5/1997 Hashimoto et al. ..... 704/231
5,797,120 A * 8/1998 Ireton ..... 704/226
5,852,806 A * 12/1998 Johnston et al. ..... 379/445
5,878,388 A * 3/1999 Nishiguchi et al. ..... 704/214
5,909,663 A * 6/1999 Iijima et al. ..... 704/226
5,960,388 A * 9/1999 Nishiguchi et al. ..... 704/208

OTHER PUBLICATIONS

Kwong, S., et al., "A Speech Coding Algorithm Based on Predictive Coding," Proceedings. DCC '95 Data Compression Conference, Snowbird, UT, IEEE Computer Soc. Press, Mar. 1995, p. 455.

Yang, G., et al., "Multiband Code–Excited Linear Prediction (MBCELP) for Speech Coding," *Signal Processing*, vol. 31, No. 2, Mar. 1993, pp. 215–227. (In German).

Heinbach, W., "Data Reduction of Speech Using Ear Characteristics," NTZ Archiv, vol. 9, No. 12, Dec. 1987, pp. 327–333.

Ozawa, K., et al., "M–LCELP Speech Coding at 4 kb/s with Multi–Mode and Multi–Codebook" *IEICE Transactions on Communications*, vol. E77B, No. 9, Sep. 1994, pp. 1114–1121.

Tremain, T.E., "The Government Standard Linear Predictive Coding Algorithm–LPC: 10," *Speech Technology*, Apr. 1982, pp. 40–49.

McCree, A.V., et al., "A Mixed Excitation LPC Vocoder Model for Low Bit Rate Speech Coding," *IEEE Transactions on Speech and Audio Processing*, vol. 3, No. 4, Jul. 1995, pp. 242–250.

(List continued on next page.)

*Primary Examiner*—Vijay Chawan
*Assistant Examiner*—Michael N. Opsasnick

(57) ABSTRACT

An audio signal is decomposed into lower and upper sub-band and at least the noise component of the sub-band is encoded. At the decoder the audio signal is synthesised by a decoding means which utilises a synthesised noise excitation signal and a filter to reproduce the noise component in the upper sub-band.

36 Claims, 7 Drawing Sheets

OTHER PUBLICATIONS

Voiers, W.D., "Diagnostic Evaluation of Speech Intelligibility," *Diagnostic Evaluation of Speech Intelligibility* (M. E. Hawley, cd.), Dowden Hutchinson & Ross, Inc., 1977, pp. 374–387.

McElroy, C., et al., "Wideband Speech Coding in 7.2 kb/s," *ICASSP, IEEE*, 1993, pp. II–620–II–623.

Roberts, R.A., et al., "Digital Signal Processing," Chapter 11, Addison–Wesley, p.527.

Varga, A., et al., "Control Experiments on Noise Compensation in Hidden Markov model Based Continuous World Recognition," *Eurospeech*, vol. 89, pp. 167–170.

Rice, R.F., et al., "Adaptive Variable–Length Coding for Efficient Compression of Spacecraft Television Data," *IEEE Transactions on Communication Technology*, vol. COM–19, No. 6, Dec. 1971, pp. 889–897.

Database Inspec Institute of Electrical Engineers, Stevenage, GB Inspec No. 5730504, Atkinson I et al: "High quality split band LPC vocoder operating at low bit rates" XP002072022 see abstract –& 1997 IEEE International Conference on Acoustics, Speech, and Signal Processing (CAT No. 97CB36502), 1997 IEEE International Conference on Acoustics, Speech, and Signal Processing,) Munich, Germany, Apr. 21–24, 1997, ISBN 0–8186–7919–0, 1997, Los Alamitos, CA. USA, IEEE Comput. Soc. Press, USA, pp. 1559–1562 vol. 2, XP002072023.

Gao Yang; "multiband code–excited linear prediction (MBCELP) for speech coding" Signal Processing vol. 31, No. 2, Mar. 1993–Mar. 1993, Amsterdam, NL. pp. 215–227, XPOOO345441 see abstract: figure 3 see p. 220, left–hand column, line 1–right–hand column, line 13.

Xavier Maitre: "7 kHz audio coding within 64 kbit/s" IEE Joural on Selected Areas in Communications, vol. 6, No. 2, Feb. 1988, New York, U.S. pp. 283–298, XP002072021 cited in the application see abstract see paragraph D. B.—paragraph D. C.

Ephraim Y et al: "A Signal Subspace Approach for Speech Enhancement" IEE Transactions OSN Speech and Audio Processing. vol. 3, No. 4, Jul. 1995, pp. 251–266, XP000633069 see abstract.

Yank G et al; "Band–Widened Harmonic Vocoder at 2 to 4 KBPS" Proceedings of the International Conference on Acoustics, Speech, and Signal Processing (ICASSP), Detroit, May 9–12, 1995 Speech vol. vol. 1, May 9, 1995, Institute of Electrical And Electronics Engineers, pp. 504–507, XP000658041 see abstract see paragraph 4.

* cited by examiner

AUDIO CODING SYSTEMS AND METHODS

FIELD OF THE INVENTION

This invention relates to audio coding systems and methods and in particular, but not exclusively, to such systems and methods for coding audio signals at low bit rates.

BACKGROUND OF THE INVENTION

In a wide range of applications it is desirable to provide a facility for the efficient storage of audio signals at a low bit rate so that they do not occupy large amounts of memory, for example in computers, portable dictation equipment, personal computer appliances, etc. Equally, where an audio signal is to be transmitted, for example to allow video conferencing, audio streaming, or is telephone communication via the Internet, etc., a low bit rate is highly desirable. In both cases, however, high intelligibility and quality are important and this invention is concerned with a solution to the problem of providing coding at very low bit rates whilst preserving a high level of intelligibility and quality, and also of providing a coding system which operates well at low bit rates with both speech and music.

In order to achieve a very low bit rate with speech signals it is generally recognised that a parametric coder or "vocoder" should be used rather than a waveform coder. A vocoder encodes only parameters of the waveform, and not the waveform itself, and produces a signal that sounds like speech but with a potentially very different waveform.

A typical example is the LPC10 vocoder (Federal Standard 1015) as described in T. E. Tremaine "The Government Standard Linear Predictive Coding Algorithm: LPC10; Speech Technology, pp 40–49, 1982) superseded by a similar algorithm LPClOe, the contents of both of which are incorporated herein by reference. LPC10 and other vocoders have historically operated in the telephony bandwidth (0–4 kHz) as this bandwidth is thought to contain all the information necessary to make speech intelligible. However we have found that the quality and intelligibility of speech coded at bit rates as low as 2.4 Kbit/s in this way is not adequate for many current commercial applications.

The problem is that to improve the quality, more parameters are needed in the speech model, but encoding these extra parameters means fewer bits are available for the existing parameters. Various enhancements to the LPC10e model have been proposed for example in A. V. McCree and T. P. Barnwell III "A Mixed Excitation LPC Vocoder Model for Low Bit Rate Speech Coding"; IEEE-Trans Speech and Audio Processing Vol.3 No.4 July 1995, but even with all these the quality is barely adequate.

In an attempt to further enhance the model we looked at encoding a wider bandwidth (0–8 kHz). This has never been considered for vocoders because the extra bits needed to encode the upper band would appear to vastly outweigh any benefit in encoding it. Wideband encoding is normally only considered for good quality coders, where it is used to add greater naturalness to the speech rather than to increase intelligibility, and requires a lot of extra bits.

One common way of implementing a wideband system is to split the signal into lower and upper sub-bands, to allow the upper sub-band to be encoded with fewer bits. The two bands are decoded separately and then added together as described in the ITU Standard G722 (X. Maitre, "7 kHz audio coding within 64 kbit/s", IEEE Journal on Selected Areas in Comm., vol.6, No.2, pp283–298, Feb 1988).

Applying this approach to a vocoder suggested that the upper band should be analysed with a lower order LPC than the lower band (we found second order adequate). We found it needed a separate energy value, but no pitch and voicing decision, as the ones from the lower band can be used. Unfortunately the recombination of the two synthesized bands produced artifacts which we deduced were caused by phase mismatch between the two bands. We overcame this problem in the decoder by combining the LPC and energy parameters of each band to produce a single, high-order wideband filter, and driving this with a wideband excitation signal.

Surprisingly, the intelligibility of the wideband LPC vocoder for clean speech was significantly higher compared to the telephone bandwidth version at the same bit rate, producing a DRT score (as described in W. D. Voiers, 'Diagnostic evaluation of speech intelligibility', in Speech Intelligibility and Speaker Recognition (M. E. Hawley, cd.) pp. 374–387, Dowden, Hutchinson & Ross, Inc., 1977) of 86.8 as opposed to 84.4 for the narrowband coder.

However, for speech with even a small amount of background noise, the synthesised signal sounded buzzy and contained artifacts in the upper band. Our analysis showed that this was because the encoded upper band energy was being boosted by the background noise, which during the synthesis of voiced speech boosted the upper-band harmonics, creating a buzzy effect.

On further detailed investigation we found that the increase in intelligibility was mainly a result of better encoding of the unvoiced fricatives and plosives, not the voiced sections. This led us to a different approach in the decoding of the upper band, where we synthesized only noise, restricting the harmonics of the voiced speech to the lower band only. This removed the buzz, but could instead add hiss if the encoded upper band energy was high, because of upper band harmonics in the input signal. This could be overcome by using the voicing decision, but we found the most reliable way was to divide the upper band input signal into noise and harmonic (periodic) components, and encode only the energy of the noise component.

This approach has two unexpected benefits, which greatly enhance the power of the technique. Firstly, as the upper band contains only noise there are no longer problems matching the phase of the upper and lower bands, which means that they can be synthesized completely separately even for a vocoder. In fact the coder for the lower band can be totally separate, and even be an off-the-shelf component. Secondly, the upper band encoding is no longer speech specific, as any signal can be broken down into noise and harmonic components, and can benefit from reproduction of the noise component where otherwise that frequency band would not be reproduced at all. This is particularly true for rock music, which has a strong percussive element to it.

The system is a fundamentally different approach to other wideband extension techniques, which are based on waveform encoding as in McElroy et al: Wideband Speech Coding in 7.2 KB/s ICASSP 93 pp 11-620–II-623. The problem of waveform encoding is that it either requires a large number of bits as in G722 (Supra), or else poorly reproduces the upper band signal (McElroy et al), adding a lot of quantisation noise to the harmonic components.

In this specification, the term "vocoder" is used broadly to define a speech coder which codes selected model parameters and in which there is no explicit coding of the residual waveform, and the term includes coders such as multi-band excitation coders (MBE) in which the coding is done by splitting the speech spectrum into a number of bands and extracting a basic set of parameters for each band.

The term vocoder analysis is used to describe a process which determines vocoder coefficients including at least LPC coefficients and an energy value. In addition, for a lower sub-band the vocoder coefficients may also include a voicing decision and for voiced speech a pitch value.

SUMMARY OF THE INVENTION

According to one aspect of this invention there is provided an audio coding system for encoding and decoding an audio signal, said system including an encoder and a decoder, said encoder comprising:

means for decomposing said audio signal into an upper and a lower sub-band signal;

lower sub-band coding means for encoding said lower sub-band signal;

upper sub-band coding means for encoding at least the non-periodic component of said upper sub-band signal according to a source-filter model;

said decoder means comprising means for decoding said encoded lower sub-band signal and said encoded upper sub-band signal, and for reconstructing therefrom an audio output signal, wherein said decoding means comprises filter means, and excitation means for generating an excitation signal for being passed by said filter means to produce a synthesised audio signal, said excitation means being operable to generate an excitation signal which includes a substantial component of synthesised noise in a frequency band corresponding to the upper sub-band of said audio signal.

Although the decoder means may comprise a single decoding means covering both the upper and lower sub-bands of the encoder, it is preferred for the decoder means to comprise lower sub-band decoding means and upper sub-band decoding means, for receiving and decoding the encoded lower and upper sub-band signals respectively.

In a particular preferred embodiment, said upper frequency band of said excitation signal substantially wholly comprises a synthesised noise signal, although in other embodiments the excitation signal may comprise a mixture of a synthesised noise component and a further component corresponding to one or more harmonics of said lower sub-band audio signal.

Conveniently, the upper sub-band coding means comprises means for analysing and encoding said upper sub-band signal to obtain an upper sub-band energy or gain value and one or more upper sub-band spectral parameters. The one or more upper sub-band spectral parameters preferably comprise second order LPC coefficients.

Preferably, said encoder means includes means for measuring the noise energy in said upper sub-band thereby to deduce said upper sub-band energy or gain value. Alternatively, said encoder means may include means for measuring the whole energy in said upper sub-band signal thereby to deduce said upper sub-band energy or gain value.

To save unnecessary usage of the bit rate, the system preferably includes means for monitoring said energy in said upper sub-band signal and for comparing this with a threshold derived from at least one of the upper and lower sub-band energies, and for causing said upper sub-band encoding means to provide a minimum code output if said monitored energy is below said threshold.

In arrangements intended primarily for speech coding, said lower sub-band coding means may comprise a speech coder, including means for providing a voicing decision. In these cases, said decoder means may include means responsive to the energy in said upper band encoded signal and said voicing decision to adjust the noise energy in said excitation signal dependent on whether the audio signal is voiced or unvoiced.

Where the system is intended primarily for music, said lower sub-band coding means may comprise any of a number of suitable waveform coders, for example an MPEG audio coder.

The division between the upper and lower sub-bands may be selected according to the particular requirements, thus it may be about 2.75 kHz, about 4 kHz, about 5.5 kHz, etc.

Said upper sub-band coding means preferably encodes said noise component with a very low bit rate of less than 800 bps and preferably of about 300 bps.

Where the upper sub-band is analysed to obtain an energy gain value and one or more spectral parameters, said upper sub-band signal is preferably analysed with relatively long frame periods to determine said spectral parameters and with relatively short frame periods to determine said energy or gain value.

In another aspect, the invention provides a system and associated method for very low bit rate coding in which the input signal is split into sub-bands, respective vocoder coefficients obtained and then together recombined to an LPC filter.

Accordingly in this aspect, the invention provides a vocoder system for compressing a signal at a bit rate of less than 4.8 Kbit/s and for resynthesizing said signal, said system comprising encoder means and decoder means, said encoder means including:

filter means for decomposing said speech signal into lower and upper sub-bands together defining a bandwidth of at least 5.5 kHz;

lower sub-band vocoder analysis means for performing a relatively high order vocoder analysis on said lower sub-band to obtain vocoder coefficients representative of said lower sub-band;

upper sub-band vocoder analysis means for performing a relatively low order vocoder analysis on said upper sub-band to obtain vocoder coefficients representative of said upper sub-band;

coding means for coding vocoder parameters including said lower and upper sub-band coefficients to provide a compressed signal for storage and/or transmission, and said decoder means including:

decoding means for decoding said compressed signal to obtain vocoder parameters including said lower and upper sub-band vocoder coefficients;

synthesising means for constructing an LPC filter from the vocoder parameters for said upper and lower sub-bands and re-synthesising said speech signal from said filter and from an excitation signal.

Preferably said lower sub-band analysis means applies tenth order LPC analysis and said upper sub-band analysis means applies second order LPC analysis.

The invention also extends to audio encoders and audio decoders for use with the above systems, and to corresponding methods.

Whilst the invention has been described above it extends to any inventive combination of the features set out above or in the following description.

BRIEF DESCRIPTION OF THE DRAWINGS

The invention may be performed in various ways, and, by way of example only, two embodiments and various modifications thereof will now be described in detail, reference being made to the accompanying drawings, in which.

Figure 1:
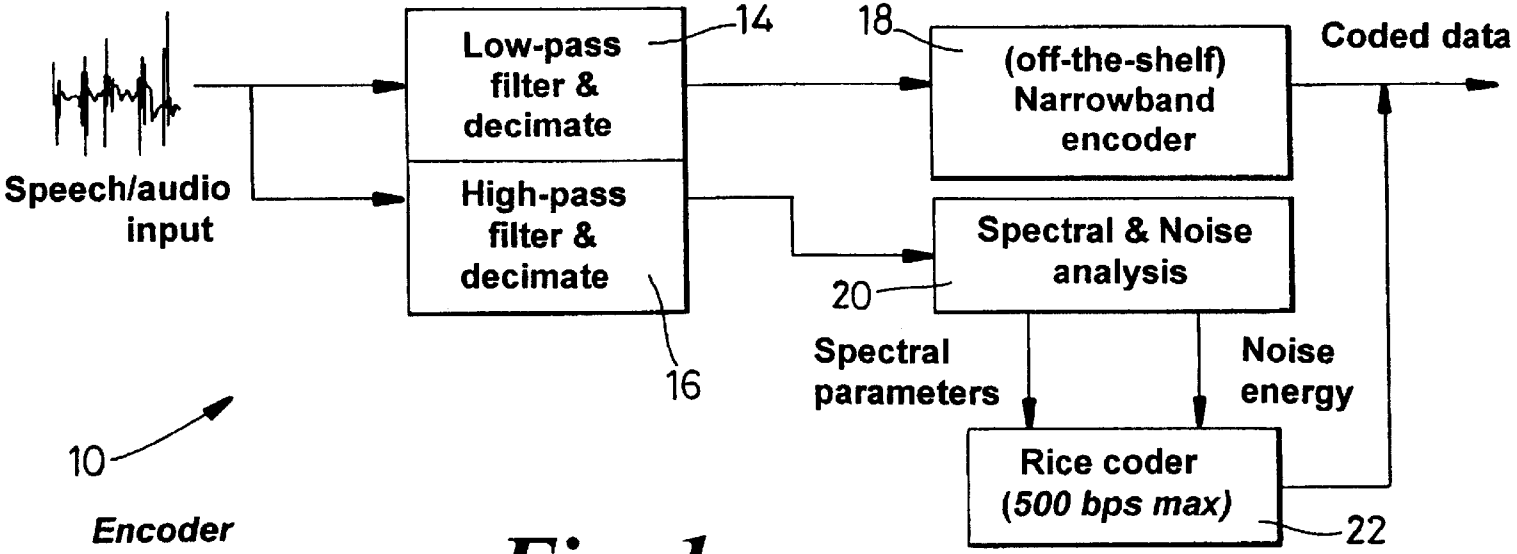
FIG. 1 is a block diagram of an encoder of a first embodiment of a wideband codec in accordance with this invention.

In this description we describe two different embodiments of the invention, both of which utilise sub-band coding. In the first embodiment, a coding scheme is implemented in which only the noise component of the upper band is encoded and resynthesized in the decoder.

The second embodiment employs an LPC vocoder scheme for both the lower and upper sub-bands to obtain parameters which are combined to produce a combined set of LPC parameters for controlling an all pole filter.

By way of introduction to the first embodiment, current audio and speech coders, if given an input signal with an extended bandwidth, simply bandlimit the input signal before coding. The technology described here allows the extended bandwidth to be encoded at a bit rate insignificant compared to the main coder. It does not attempt to fully reproduce the upper sub-band, but still provides an encoding that considerably enhances the quality (and intelligibility for speech) of the main bandlimited signal.

The upper band is modelled in the usual way as an all-pole filter driven by an excitation signal. Only one or two parameters are needed to describe the spectrum. The excitation signal is considered to be a combination of white noise and periodic components, the latter possibly having very complex relationships to one another (true for most music). In the most general form of the codec described below, the periodic components are effectively discarded. All that is transmitted is the estimated energy of the noise component and the spectral parameters; at the decoder, white noise alone is used to drive the all-pole filter.

The key and original concept is that the encoding of the upper band is completely parametric—no attempt is made to encode the excitation signal itself. The only parameters encoded are the spectral parameters and an energy parameter.

This aspect of the invention may be implemented either as a new form of coder or as a wideband extension to an existing coder. Such an existing coder may be supplied by a third party, or perhaps is already available on the same system (eg ACM codecs in Windows95/NT). In this sense it acts as a parasite to that codec, using it to do the encoding of the main signal, but producing a better quality signal than the narrowband codec can by itself. An important characteristic of using only white noise to synthesize the upper band is that it is trivial to add together the two bands—they only have to be aligned to within a few milliseconds, and there are no phase continuity issues to solve. Indeed, we have produced numerous demonstrations using different codecs and had no difficulty aligning the signals.

The invention may be used in two ways. One is to improve the quality of an existing narrowband (4 kHz) coder by extending the input bandwidth, with a very small increase in bit rate. The other is to produce a lower bit rate coder by operating the lower band coder on a smaller input bandwidth (typically 2.75 kHz), and then extending it to make up for the lost bandwidth (typically to 5.5 kHz).

Figure 2:
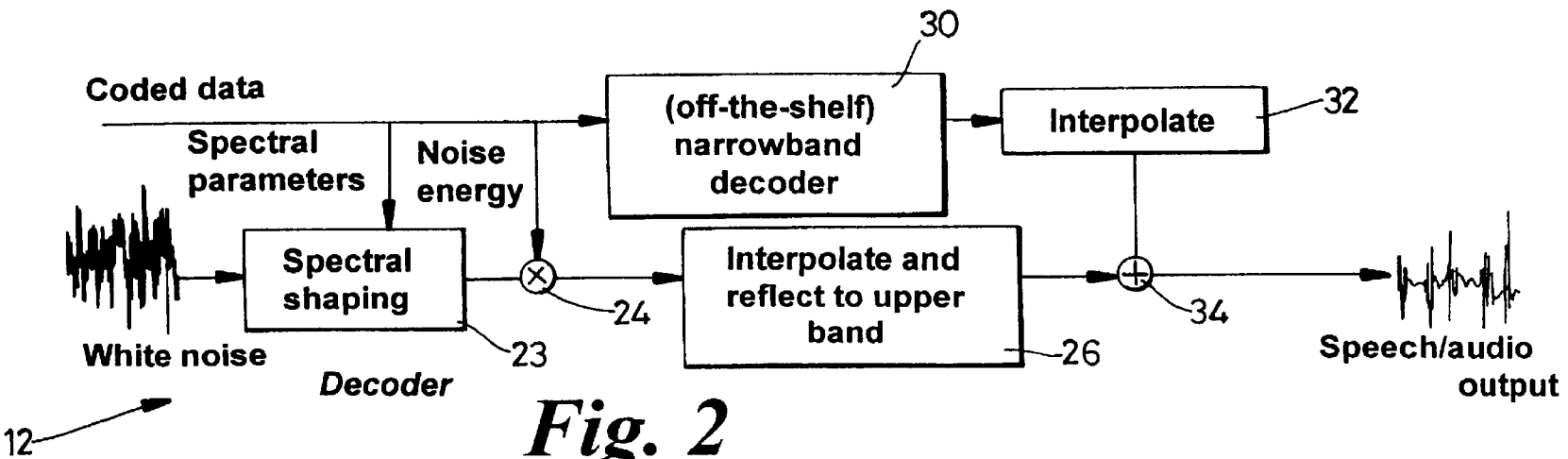
FIG. 2 is a block diagram of a decoder of the first embodiment of a wideband codec in accordance with this invention.

FIGS. 1 and 2 illustrate an encoder 10 and decoder 12 respectively for a first embodiment of the codec. Referring initially to FIG. 1, the input audio signal passes to a low-pass filter 14 where it is low pass filtered to form a lower sub-band signal and decimated, and also to a high-pass filter 16 where it is high pass filtered to form an upper sub-band signal and decimated.

The filters need to have both a sharp cutoff and good stop-band attenuation. To achieve this, either 73 tap FIR filters or 8th order elliptic filters are used, depending on which can run faster on the processor used. The stopband attenuation should be at least 40 dB and preferably 60 dB, and the pass band ripple small −0.2 dB at most. The 3 dB point for the filters should be the target split point (4 kHz typically).

The lower sub-band signal is supplied to a narrowband encoder 18. The narrowband encoder may be a vocoder or a waveband encoder. The upper sub-band signal is supplied to an upper sub-band analyser 20 which analyses the spectrum of the upper sub-band to determine parametric coefficients and its noise component, as to be described below.

The spectral parameters and the log of the noise energy value are quantised, subtracted from their previous values (i.e. differentially encoded) and supplied to a Rice coder 22 for coding and then combined with the coded output from the narrowband encoder 18.

In the decoder 12, the spectral parameters are obtained from the coded data and applied to a spectral shape filter 23. The filter 23 is excited by a synthetic white noise signal to produce a synthesized non-harmonic upper sub-band signal whose gain is adjusted in accordance with the noise energy value at 24. The synthesised signal then passes to a processor 26 which interpolates the signal and reflects it to the upper sub-band. The encoded data representing the lower sub-band signal passes to a narrowband decoder 30 which decodes the lower sub-band signal which is interpolated at 32 and then recombined at 34 to form the synthesized output signal.

In the above embodiment, Rice coding is only appropriate if the storage/transmission mechanism can support variable bit-rate coding, or tolerate a large enough latency to allow the data to be blocked into fixed-sized packets. Otherwise a conventional quantisation scheme can be used without affecting the bit rate too much.

Figure 3:
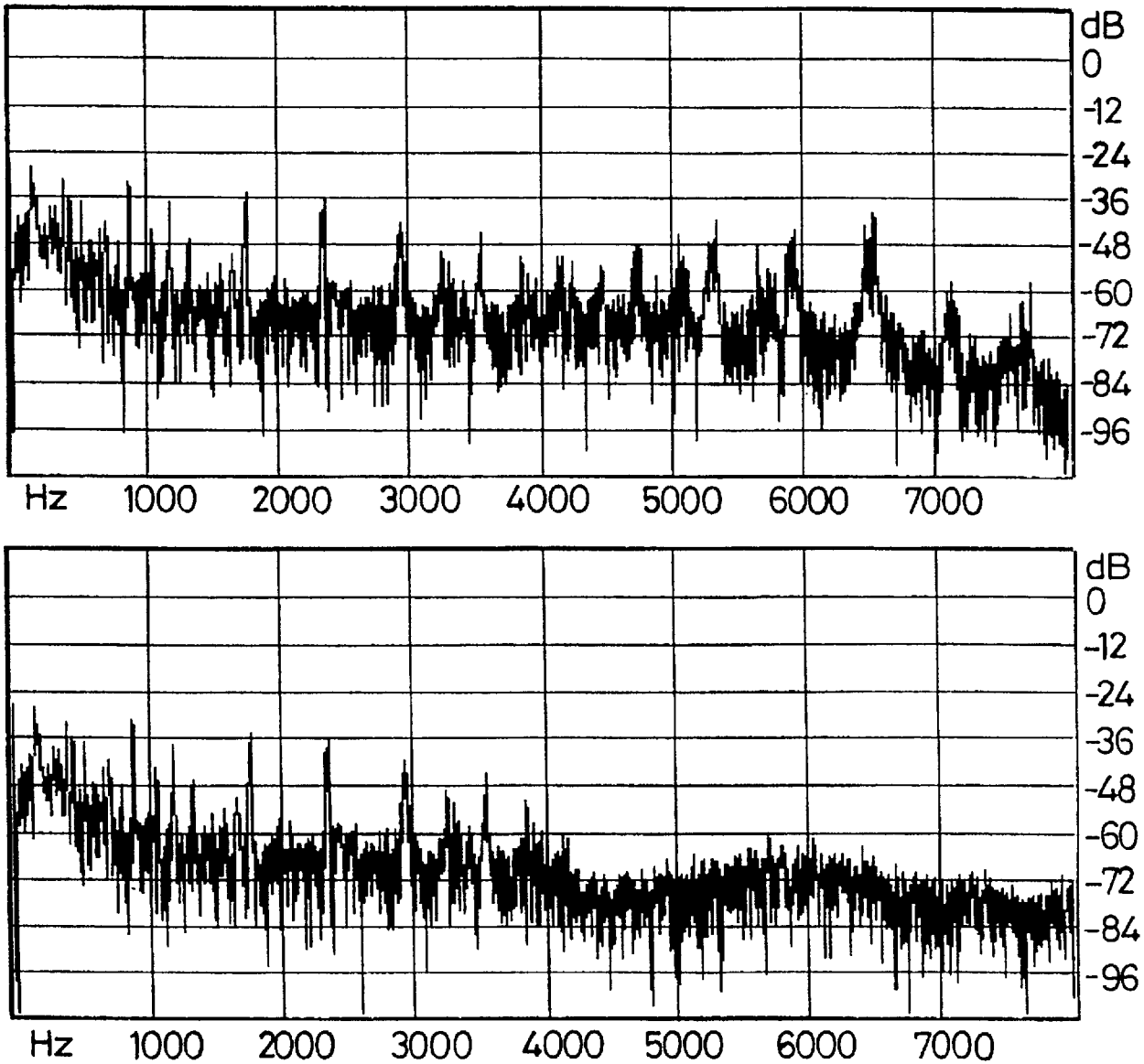
FIG. 3 are spectra showing the result of the encoding-decoding process implemented in the first embodiment.

The result of the whole encoding-decoding process is illustrated in the spectra in FIG. 3, where the upper one is a frame containing both noise and strong harmonic components from Nakita by Elton John, and the lower one is the same frame with the 4–8 kHz region encoded using the wideband extension described above.

Referring now in more detail to the spectral and noise component analysis of the upper sub-band, the spectral analysis derives two LPC coefficients using the standard autocorrelation method, which is guaranteed to produce a stable filter. For quantisation, the LPC coefficients are converted into reflection coefficients and quantised with nine levels each. These LPC coefficients are then used to inverse filter the waveform to produce a whitened signal for the noise component analysis.

The noise component analysis can be done in a number of ways. For instance the upper sub-band may be full-wave rectified, smoothed and analysed for periodicity as described in McCree et al. However, the measurement is more easily made by direct measurement in the frequency domain.

Accordingly, in the present embodiment a 256-point FFT is performed on the whitened upper sub-band signal. The noise component energy is taken to be the median of the FFT bin energies. This parameter has the important property that if the signal is completely noise, the expected value of the median is just the energy of the signal. But if the signal has periodic components, then so long as the average spacing is greater than twice the frequency resolution of the FFT, the median will fall between the peaks in the spectrum. But if the spacing is very tight, the ear will notice little difference if white noise is used instead.

For speech (and some audio signals), it is necessary to perform the noise energy calculation over a shorter interval than the LPC analysis. This is because of the sharp attack on plosives, and because unvoiced spectra do not move very quickly. In this case, the ratio of the median to the energy of the FFT, i.e. the fractional noise component, is measured. This is then used to scale all the measured energy values for that analysis period.

The noise/periodic distinction is an imperfect one, and the noise component analysis itself is imperfect. To allow for this, the upper sub-band analyser 20 may scale the energy in the upper band by a fixed factor of about 50%. Comparing the original signal with the decoded extended signal sounds as if the treble control is turned down somewhat. But the difference is negligible compared to the complete removal of the treble in the unextended decoded signal.

The noise component is not usually worth reproducing when it is small compared to the harmonic energy in the upper band, or very small compared to the energy in the lower band. In the first case it is in any case hard to measure the noise component accurately because of the signal leakage between FFT bins. To some degree this is also true in the second case because of the finite attenuation in the stopband of the low-band filter. So in a modification of this embodiment the upper sub-band analyser 20 may compare the measured upper sub-band noise energy against a threshold derived from at least one of the upper and lower sub-band energies and, if it is below the threshold, the noise floor energy value is transmitted instead. The noise floor energy is an estimate of the background noise level in the upper band and would normally be set equal to the lowest upper band energy measured since the start of the output signal.

Figure 4:
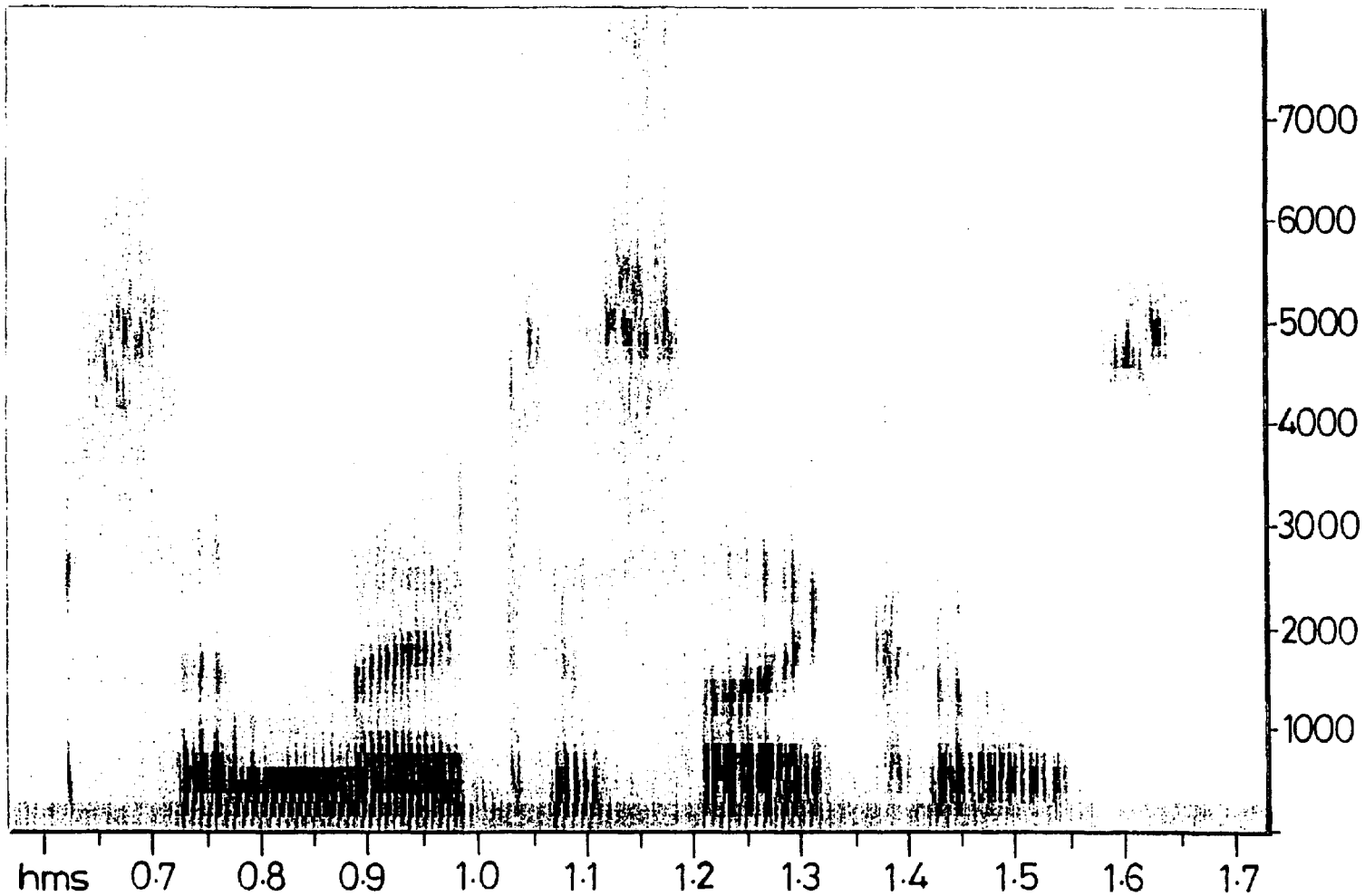
FIG. 4 is a spectrogram of a male speaker.

Turning now to the performance of this embodiment, FIG. 4, is a spectrogram of a male speaker. The vertical axis, frequency, stretches to 800 Hz, twice the range of standard telephony coders (4 kHz). The darkness of the plot indicates signal strength at that frequency. The horizontal axis is time.

It will be seen that above 4 kHz the signal is mostly noise from fricatives or plosives, or not there at all. In this case the wideband extension produces an almost perfect reproduction of the upper band.

For some female and children's voices, the frequency at which the voiced speech has lost most of its energy is higher than 4 kHz. Ideally in this case, the band split should be done a little higher (5.5 kHz would be a good choice). But even if this is not done, the quality is still better than an unextended codec during unvoiced speech, and for voiced speech it is exactly the same. Also the gain in intelligibility comes through good reproduction of the fricatives and plosives, not through better reproduction of the vowels, so the split point affects only the quality, not the intelligibility.

For reproduction of music, the effectiveness of the wideband extension depends somewhat on the kind of music. For rock/pop where the most noticeable upper band components are from the percussion, or from the "softness" of the voice (particularly for females), the noise-only synthesis works very well, even enhancing the sound in places. Other music has only harmonic components in the upper band—piano for instance. In this case nothing is reproduced in the upper band. However, subjectively the lack of higher frequencies seems less important for sounds where there are a lot of lower frequency harmonics.

Figure 5:
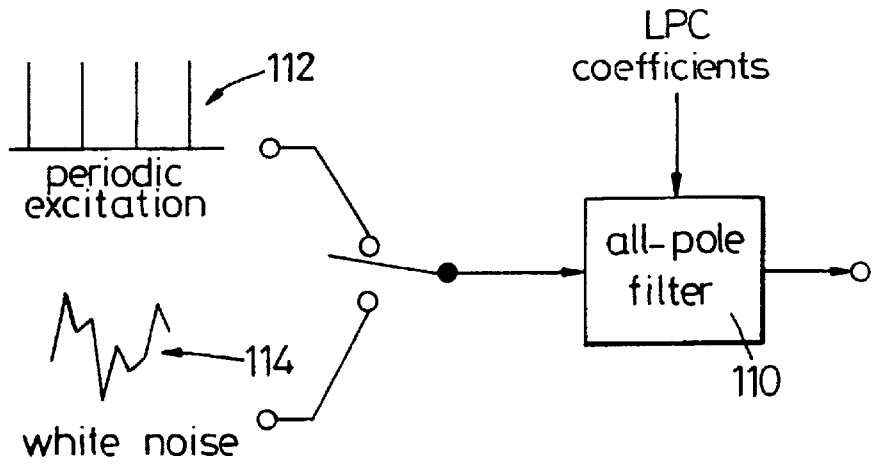
FIG. 5 is a block diagram of the speech model assumed by a typical vocoder.
Figure 6:
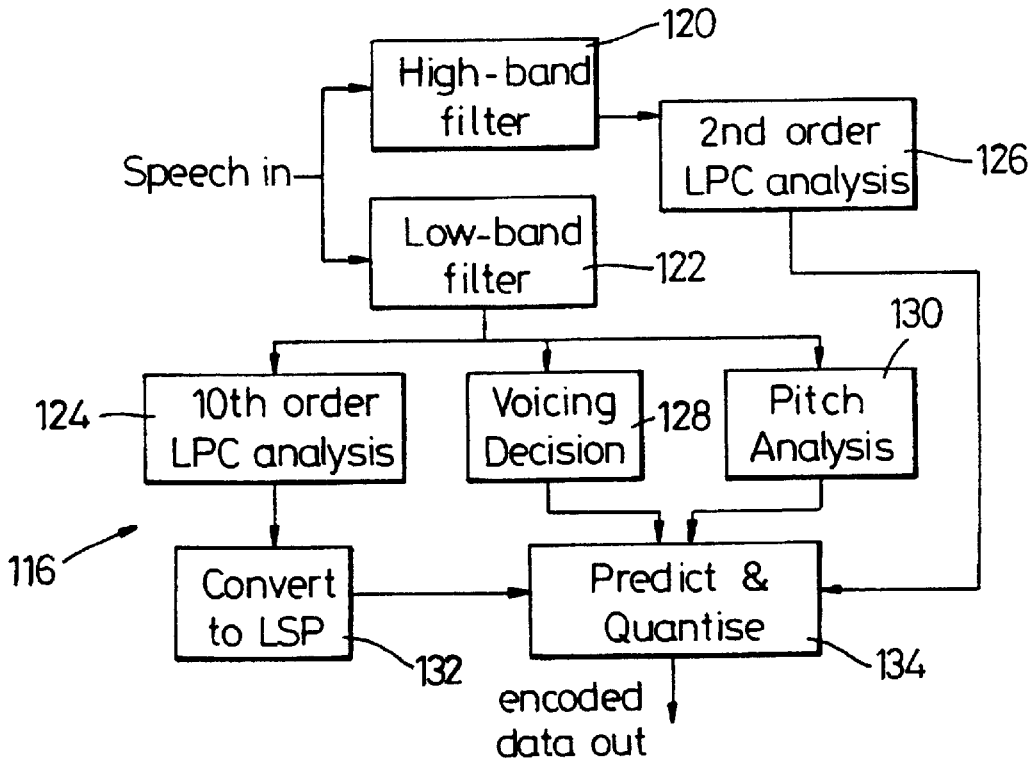
FIG. 6 is a block diagram of an encoder of a second embodiment of a codec in accordance with this invention.

Referring now to the second embodiment of the codec which will be described with reference to FIGS. 5 to 12 this embodiment is based on the same principles as the well-known LPC10 vocoder (as described in T. E. Tremain "The Government Standard Linear Predictive Coding Algorithm: LPC10"; Speech Technology, pp 40–49, 1982), and the speech model assumed by the LPC10 vocoder is shown in FIG. 5. The vocal tract, which is modeled as an all-pole filter 110, is driven by a periodic excitation signal 112 for voiced speech and random white noise 114 for unvoiced speech.

Figure 7:
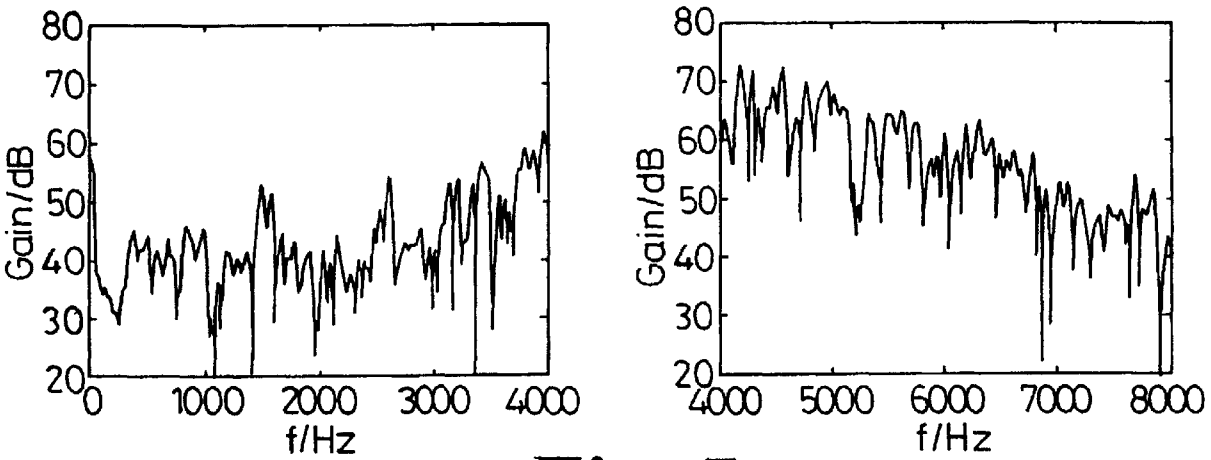
FIG. 7 shows two sub-band short-time spectra for an unvoiced speech frame sampled at 16 kHz.
Figure 8:
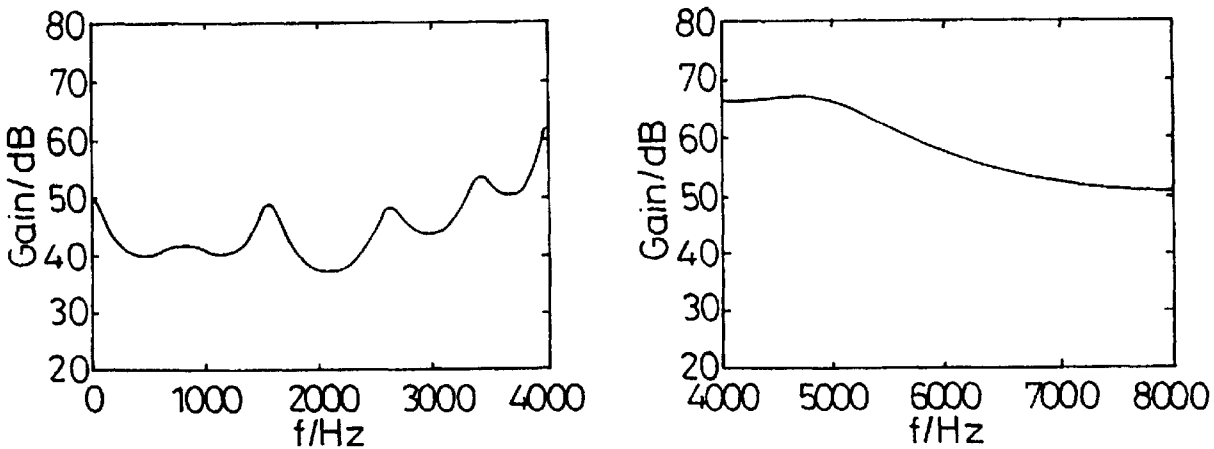
FIG. 8 shows two sub-band LPC spectra for the unvoiced speech frame of FIG. 7.
Figure 9:
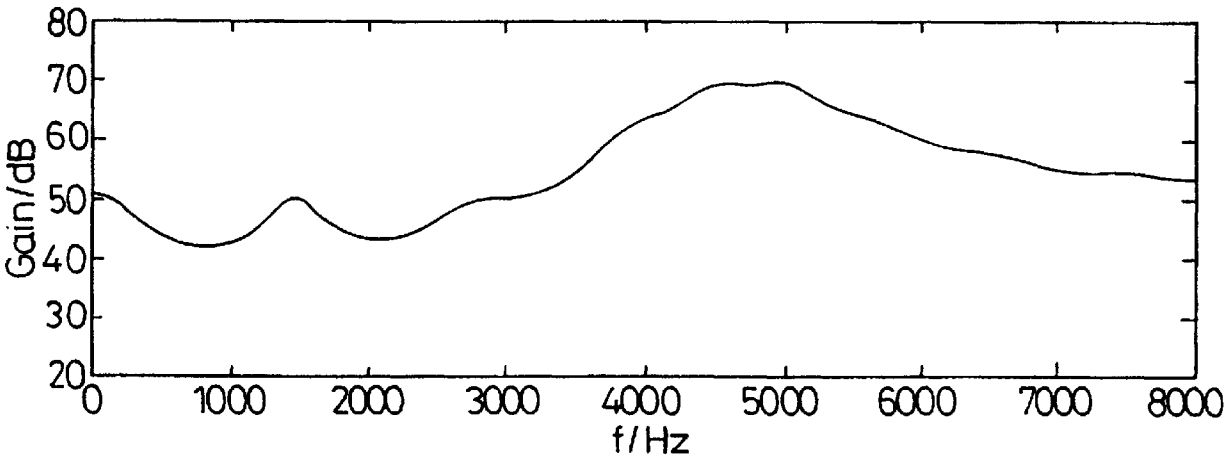
FIG. 9 shows the combined LPC spectrum for the unvoiced speech frame of FIGS. 7 and 8.

The vocoder consists of two parts, the encoder 116 and the decoder 118. The encoder 116, shown in FIG. 6, splits the input speech into frames equally spaced in time. Each frame is then split into bands corresponding to the 0–4 kHz and 4–8 kHz regions of the spectrum. This is achieved in a computationally efficient manner using 8th-order elliptic filters. High-pass and low-pass filters 120 and 122 respectively are applied and the resulting signals decimated to form the two sub-bands. The upper sub-band contains a mirrored form of the 4–8 kHz spectrum. Ten Linear Prediction Coding (LPC) coefficients are computed at 124 from the lower sub-band, and two LPC coefficients are computed at 126 from the high-band, as well as a gain value for each band. FIGS. 7 and 8 show the two sub-band short-term spectra and the two sub-band LPC spectra respectively for a typical unvoiced signal at a sample rate of 16 kHz and FIG. 9 shows the combined LPC spectrum. A voicing decision 128 and pitch value 130 for voiced frames are also computed from the lower sub-band. (The voicing decision can optionally use upper sub-band information as well). The ten low-band LPC parameters are transformed to Line Spectral Pairs (LSPs) at 132, and then all the parameters are coded using a predictive quantiser 134 to give the low-bit-rate data stream.

Figure 10:
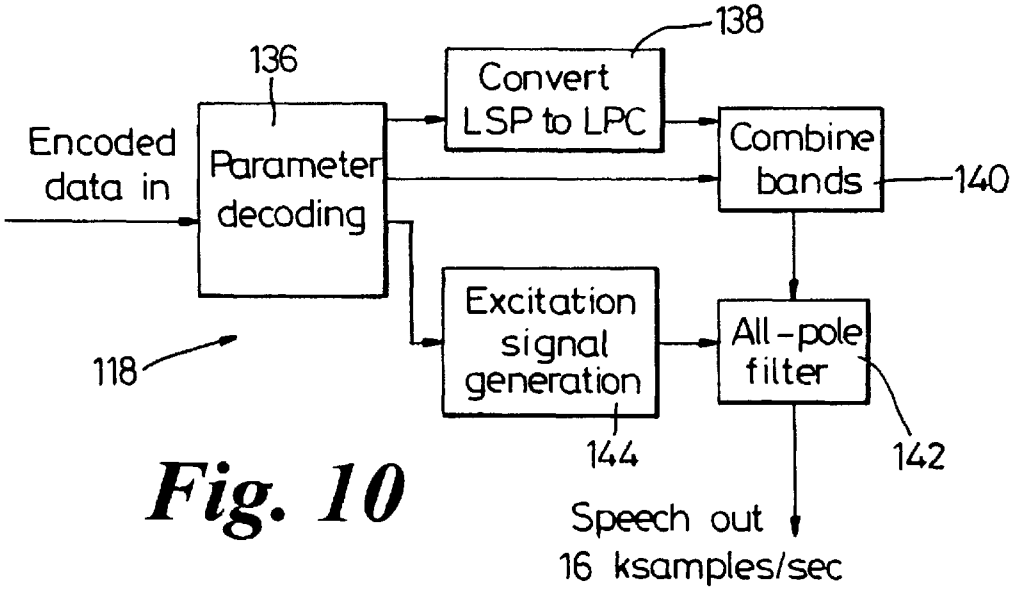
FIG. 10 is a block diagram of a decoder of the second embodiment of a codec in accordance with this invention.

The decoder 118 shown in FIG. 10 decodes the parameters at 136 and, during voiced speech, interpolates between parameters of adjacent frames at the start of each pitch period. The ten lower sub-band LSPs are then converted to LPC coefficients at 138 before combining them at 140 with the two upper sub-band coefficients to produce a set of eighteen LPC coefficients. This is done using an Autocorrelation Domain Combination technique or a Power Spectral Domain Combination technique to be described below. The LPC parameters control an all-pole filter 142, which is excited with either white noise or an impulse-like waveform periodic at the pitch period from an excitation signal generator 144 to emulate the model shown in FIG. 5. Details of the voiced excitation signal are given below.

The particular implementation of the second embodiment of the vocoder will now be described. For a more detailed discussion of various aspects, attention is directed to L. Rabiner and R. W. Schafer, 'Digital Processing of Speech Signals', Prentice Hall, 1978, the contents of which are incorporated herein by reference.

LPC Analysis

A standard autocorrelation method is used to derive the LPC coefficients and gain for both the lower and upper sub-bands. This is a simple approach which is guaranteed to give a stable all-pole filter; however, it has a tendency to over-estimate formant bandwidths. This problem is overcome in the decoder by adaptive formant enhancement as described in A. V. McCree and T. P. Barnwell III, 'A mixed excitation lpc vocoder model for low bit rate speech encoding', IEEE Trans. Speech and Audio Processing, vol.3, pp.242–250, July 1995, which enhances the spectrum around the formants by filtering the excitation sequence with a bandwidth-expanded version of the LPC synthesis (all-pole) filter. To reduce the resulting spectral tilt, a weaker all-zero filter is also applied. The overall filter has a transfer function $H(z)=A(z/0.5)/A(z/0.8)$, where $A(z)$ is the transfer function of the all-pole filter.

Resynthesis LPC Model

To avoid potential problems due to discontinuity between the power spectra of the two sub-band LPC models, and also due to the discontinuity of the phase response, a single high-order resynthesis LPC model is generated from the sub-band models. From this model, for which an order of 18 was found to be suitable, speech can be synthesised as in a standard LPC vocoder. Two approaches are described here, the second being the computationally simpler method.

In the following, subscripts L and H will be used to denote features of hypothesised low-pass filtered versions of the wide band signal respectively, (assuming filters having cut-offs at 4 kHz, with unity response inside the pass band and zero outside), and subscripts l and h used to denote features of the lower and upper sub-band signals respectively.

Power Spectral Domain Combination

The power spectral densities of filtered wide-band signals $P_L(\omega)$ and $P_H(\omega)$, may be calculated as:

$$P_L(\omega/2)=\begin{cases} g_l^2 \Big/ \left|1+\sum_{n=1}^{p_l} a_l(n)e^{-j\omega n}\right|^2 & \text{if } \omega \le \pi \\ 0 & \text{if } \pi < \omega \le 2\pi \end{cases} \tag{1}$$

and $$P_H(\pi-\omega/2)=\begin{cases} g_h^2 \Big/ \left|1+\sum_{n=1}^{p_h} a_h(n)e^{-j\omega n}\right|^2 & \text{if } \omega < \pi \\ 0 & \text{if } \pi \ge \omega \le 2\pi \end{cases} \tag{2}$$

where $\alpha_l(n)$, $\alpha_h(n)$, and $g_l$, $g_h$ are the LPC parameters and gain respectively from a frame of speech and $p_l$, $p_h$, are the LPC model orders. The term $\pi-\omega/2$ occurs because the upper sub-band spectrum is mirrored.

The power spectral density of the wide-band signal, $P_W(\omega)$, is given by $$P_W(\omega)=P_L(\omega)+P_H(\omega). \tag{3}$$

The autocorrelation of the wide-band signal is given by the inverse discrete-time Fourier transform of $P_W(\omega)$, and from this the (18th order) LPC model corresponding to a frame of the wide-band signal can be calculated. For a practical implementation, the inverse transform is performed using an inverse discrete Fourier transform (DFT). However this leads to the problem that a large number of spectral values are needed (typically 512) to give adequate frequency resolution, resulting in excessive computational requirements.

Autocorrelation Domain Combination

For this approach, instead of calculating the power spectral densities of low-pass and high-pass versions of the wide-band signal, the autocorrelations, $r_L(\tau)$ and $r_H(\tau)$, are generated. The low-pass filtered wide-band signal is equivalent to the lower sub-band up-sampled by a factor of 2. In the time-domain this up-sampling consists of inserting alternate zeros (interpolating), followed by a low-pass filtering. Therefore in the autocorrelation domain, up-sampling involves interpolation followed by filtering by the autocorrelation of the low-pass filter impulse response.

The autocorrelations of the two sub-band signals can be efficiently calculated from the sub-band LPC models (see for example R. A. Roberts and C. T. Mullis, '*Digital Signal Processing*', chapter 11, p.527, Addison-Wesley, 1987). If $r_l(m)$ denotes the autocorrelation of the lower sub-band, then the interpolated autocorrelation, $r'_l(m)$ is given by:

$$r'_l(m)=\begin{cases} r_l(m/2) & \text{if } m=0, \pm 2, \pm 4, \ldots \\ 0 & \text{otherwise.} \end{cases} \tag{4}$$

The autocorrelation of the low-pass filtered signal $r_L(m)$, is:

$$r_L(m)=r'_l(m)*(h(m)*h(-m)), \tag{5}$$

where $h(m)$ is the low-pass filter impulse response. The autocorrelation of the high-pass filtered signal $r_H(m)$, is found similarly, except that a high-pass filter is applied.

The autocorrelation of the wide-band signal $r_w(m)$, can be expressed:

$$\text{i } r_W(m)=r_L(m)+r_H(m); \tag{6}$$

and hence the wide-band LPC model calculated. FIG. 5 shows the resulting LPC spectrum for the frame of unvoiced speech considered above.

Compared with combination in the power spectral domain, this approach has the advantage of being computationally simpler. FIR filters of order 30 were found to be sufficient to perform the upsampling. In this case, the poor frequency resolution implied by the lower order filters is adequate because this simply results in spectral leakage at the crossover between the two sub-bands. The approaches both result in speech perceptually very similar to that obtained by using an high-order analysis model on the wide-band speech.

From the plots for a frame of unvoiced speech shown in FIGS. 7, 8, and 9, the effect of including the upper-band spectral information is particularly evident here, as most of the signal energy is contained within this region of the spectrum.

Pitch/Voicing Analysis Pitch is determined using a standard pitch tracker. For each frame determined to be voiced, a pitch function, which is expected to have a minimum at the pitch period, is calculated over a range of time intervals. Three different functions have been implemented, based on autocorrelation, the Averaged Magnitude Difference Function (AMDF) and the negative Cepstrum. They all perform well; the most computationally efficient function to use depends on the architecture of the coder's processor. Over each sequence of one or more voiced frames, the minima of the pitch function are selected as the pitch candidates. The sequence of pitch candidates which minimizes a cost function is selected as the estimated pitch contour. The cost function is the weighted sum of the pitch function and changes in pitch along the path. The best path may be found in a computationally efficient manner using dynamic programming.

The purpose of the voicing classifier is to determine whether each frame of speech has been generated as the result of an impulse-excited or noise-excited model. There is a wide range of methods which can be used to make a voicing decision. The method adopted in this embodiment uses a linear discriminant function applied to; the low-band energy, the first autocorrelation coefficient of the low (and optionally high) band and the cost value from the pitch analysis. For the voicing decision to work well in high levels of background noise, a noise tracker (as described for example in A. Varga and K. Ponting, '*Control Experiments on Noise Compensation in Hidden Markov Model based Continuous Word Recognition*', pp.167–170, Eurospeech 89) can be used to calculate the probability of noise, which is then included in the linear discriminant function.

Parameter Encoding

Voicing Decision

The voicing decision is simply encoded at one bit per frame. It is possible to reduce this by taking into account the correlation between successive voicing decisions, but the reduction in bit rate is small.

Pitch

For unvoiced frames, no pitch information is coded. For voiced frames, the pitch is first transformed to the log domain and scaled by a constant (e.g. 20) to give a perceptually-acceptable resolution. The difference between transformed pitch at the current and previous voiced frames is rounded to the nearest integer and then encoded.

Gains

The method of coding the log pitch is also applied to the log gain, appropriate scaling factors being 1 and 0.7 for the low and high band respectively.

LPC Coefficients

The LPC coefficients generate the majority of the encoded data. The LPC coefficients are first converted to a representation which can withstand quantisation, i.e. one with guaranteed stability and low distortion of the underlying formant frequencies and bandwidths. The upper sub-band LPC coefficients are coded as reflection coefficients, and the lower sub-band LPC coefficients are converted to Line Spectral Pairs (LSPs) as described in F. Itakura, '*Line spectrum representation of linear predictor coefficients of speech signals*', *J. Acoust. Soc. Ameri.*, vol.57, S35(A), 1975. The upper sub-band coefficients are coded in exactly the same way as the log pitch and log gain, i.e. encoding the difference between consecutive values, an appropriate scaling factor being 5.0. The coding of the low-band coefficients is described below.

Rice Coding

In this particular embodiment, parameters are quantised with a fixed step size and then encoded using lossless coding. The method of coding is a Rice code (as described in R. F. Rice & J. R. Plaunt, '*Adaptive variable-length coding for efficient compression of spacecraft television data*', *IEEE Transactions on Communication Technology*, vol.19, no.6,pp.889–897, 1971), which assumes a Laplacian density of the differences. This code assigns a number of bits which increases with the magnitude of the difference. This method is suitable for applications which do not require a fixed number of bits to be generated per frame, but a fixed bit-rate scheme similar to the LPClOe scheme could be used.

Voiced Excitation

The voiced excitation is a mixed excitation signal consisting of noise and periodic components added together. The periodic component is the impulse response of a pulse dispersion filter (as described in McCree et al) passed through a periodic weighting filter. The noise component is random noise passed through a noise weighting filter.

The periodic weighting filter is a 20th order Finite Impulse Response (FIR) filter, designed with breakpoints (in kHz) and amplitudes:

| | | | | | | | | |
|---|---|---|---|---|---|---|---|---|
| b.p. | 0 | 0.4 | 0.6 | 1.3 | 2.3 | 3.4 | 4.0 | 8.0 |
| amp | 1 | 1.0 | 0.975 | 0.93 | 0.8 | 0.6 | 0.5 | 0.5 |

The noise weighting filter is a 20th order FIR filter with the opposite response, so that together they produce a uniform response over the whole frequency band.

LPC Parameter Encoding

Figure 11:
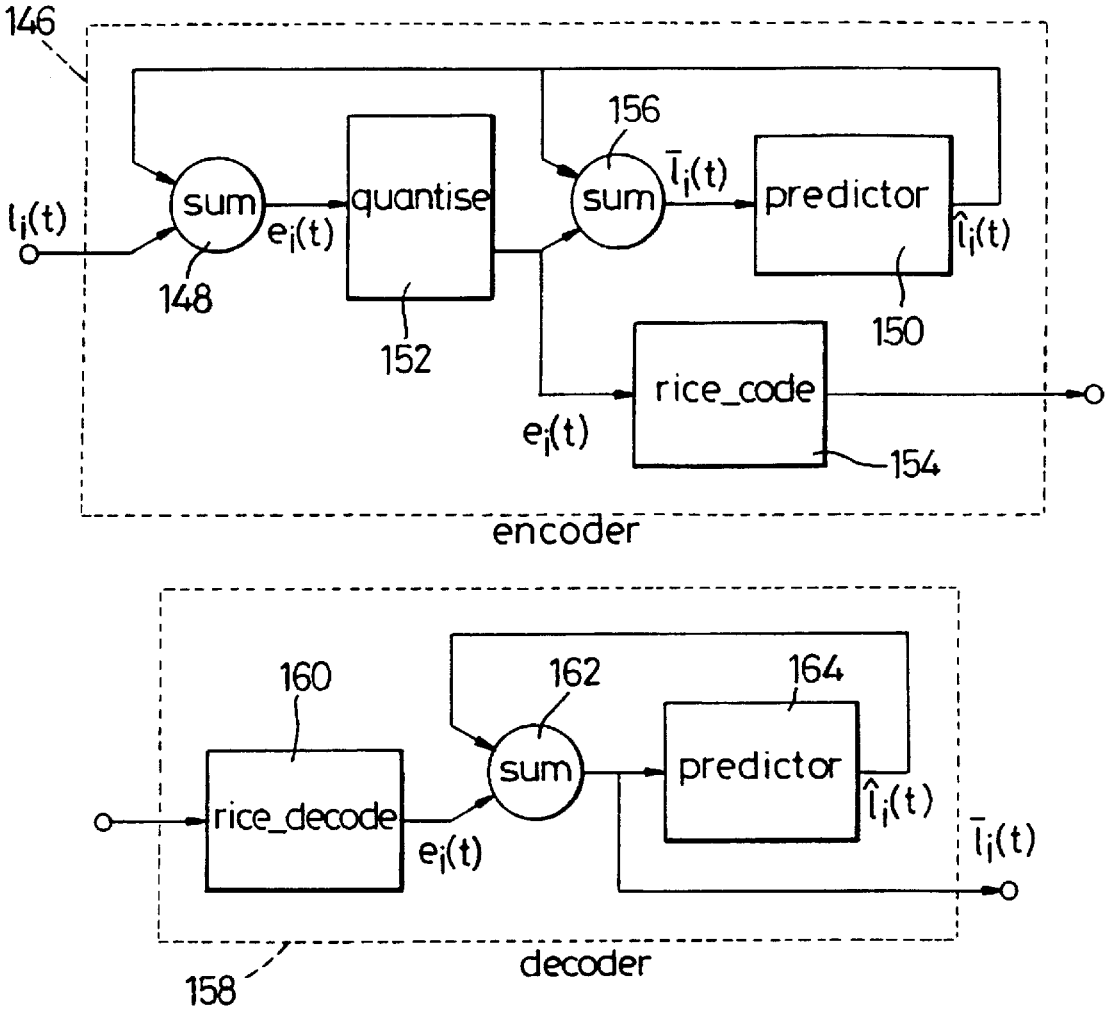
FIG. 11 is a block diagram of an LPC parameter coding scheme used in the second embodiment of this invention.
Figure 12:
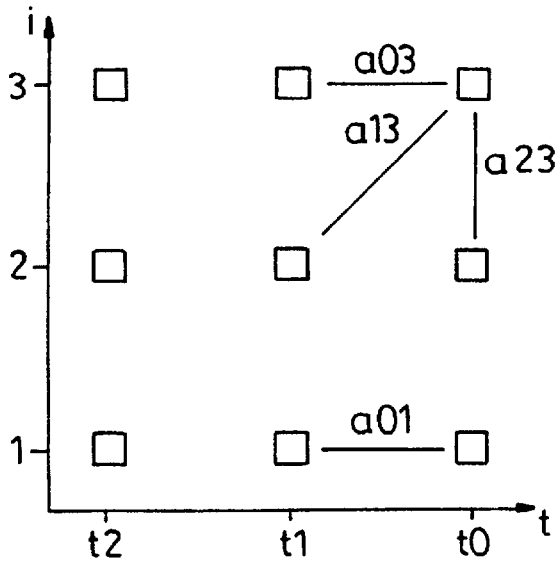
FIG. 12 shows a preferred weighting scheme for the LSP predictor employed in the second embodiment of this invention.

In this embodiment prediction is used for the encoding of the Line Spectral pair Frequencies (LSFs) and the prediction may be adaptive. Although vector quantisation could be used, scalar encoding has been used to save both computation and storage. FIG. 11 shows the overall coding scheme. In the LPC parameter encoder 146 the input $l_i(t)$ is applied to an adder 148 together with the negative of an estimate $\hat{l}_i(t)$ from the predictor 150 to provide a prediction error which is quantised by a quantiser 152. The quantised prediction error is Rice encoded at 154 to provide an output, and is also supplied to an adder 156 together with the output from the predictor 150 to provide the input to the predictor 150.

In the LPC parameter decoder 158, the error signal is Rice decoded at 160 and supplied to an adder 162 together with the output from a predictor 164. The sum from the adder 162, corresponding to an estimate of the current LSF component, is output and also supplied to the input of the predictor 164.

LSF Prediction

The prediction stage estimates the current LSF component from data currently available to the decoder. The variance of the prediction error is expected to be lower than that of the original values, and hence it should be possible to encode this at a lower bit rate for a given average error.

Let the LSF element i at time t be denoted $l_i(t)$ and the LSF element recovered by the decoder denoted $\bar{l}_i(t)$. If the LSFs are encoded sequentially in time and in order of increasing index within a given time frame, then to predict $l_i(t)$, the following values are available:

$$\{\bar{l}_j(t) | 1 \leqq j < i\}$$

and $$\{\bar{l}_j(\tau) | \tau < t \text{ and } 1 \leqq j \leqq 10\}.$$

Therefore a general linear LSF predictor can be written $$\hat{l}_i(t) = c_i + \sum_{T=t-t_0}^{t-1} \sum_{j=1}^{10} a_{ij}(t-T)\bar{l}_j(T) + \sum_{j=1}^{i-1} a_{ij}(0)\bar{l}_j(t); \tag{7}$$

where $a_{ij}(\tau)$ is the weighting associated with the prediction of $\hat{l}_i(t)$ from $\bar{l}_j(t-\tau)$.

In general only a small set of values of $a_{ij}(\tau)$ should be used, as a high-order predictor is computationally less efficient both to apply and to estimate. Experiments were performed on unquantized LSF vectors (i.e. predicting from $l_j(\tau)$ rather than $\bar{l}_j(\tau)$, to examine the performance of various predictor configurations, the results of which are:

TABLE 1

| Sys | MAC | Elements | Err/dB |
|---|---|---|---|
| A | 0 | — | −23.47 |
| B | 1 | $\alpha_{ii}$ (1) | −26.17 |
| C | 2 | $\alpha_{ii}$ (1), $\alpha_{ii-1}$ (0) | −27.31 |
| D | 3 | $\alpha_{ii}$ (1), $\alpha_{ii-1}$ (0), $\alpha_{ii-1}$ (1) | −27.74 |
| E | 2 | $\alpha_{ii}$ (1), $\alpha_{ii}$ (2) | −26.23 |
| F | 19 | $\alpha_{ii}$ (1)\|$1 \leqq j \leqq 10$, αii (0)\|$1 \leqq j \leqq i-1$ | −27.97 |

System D (shown in FIG. 12) was selected as giving the best compromise between efficiency and error.

A scheme was implemented where the predictor was adaptively modified. The adaptive update is performed according to:

$$C_{II}^{(k+)}=(1-\rho)C_{II}^{(k)}+\rho X_i X_i^T$$

$$C_{Iy}^{(k+)}=(1-\rho)C_{Iy}^{(k)}+\rho y_i X_i; \quad (8)$$

where ρ determines the rate of adaption (a value of ρ=0.005 was found suitable, giving a time constant of 4.5 seconds). The terms $C_{xx}$ and $C_{xy}$ are initialised from training data as $$C_{xx}=\frac{1}{N}\sum_i X_i X_i^T \quad \text{and}$$

$$C_{xy}=\frac{1}{N}\sum_i Y_i X_i$$

Here $y_i$ is a value to be predicted ($l_i(t)$) and $x_i$ is a vector of predictor inputs (containing 1, $l_i(t-1)$ etc.). The updates defined in Equation (8) are applied after each frame, and periodically new Minimum Mean-Squared Error (MMSE) predictor coefficients,p, are calculated by solving $C_{xx}p=C_{xy}$.

The adaptive predictor is only needed if there are large differences between training and operating conditions caused for example by speaker variations, channel differences or background noise.

Ouantisation and Coding

Given a predictor output $\hat{l}_i(t)$, the prediction error is calculated as $e_i(t)=l_i(t)-\hat{l}_i(t)$. This is uniformly quantised by scaling to give an error $\bar{e}_i(t)$ which is then losslessly encoded in the same way as all the other parameters. A suitable scaling factor is 160.0. Coarser quantisation can be used for frames classified as unvoiced.

Results

Diagnostic Rhyme Tests (DRTs) (as described in W. D. Voiers, '*Diagnostic evaluation of speech intelligibility', in Speech Intelligibility and Speaker Recognition* (M. E. Hawley, cd.) pp. 374–387, Dowden, Hutchinson & Ross, Inc., 1977) were performed to compare the intelligibility of a wide-band LPC vocoder using the autocorrelation domain combination method with that of a 4800 bps CELP coder (Federal Standard 1016) (operating on narrow-band speech). For the LPC vocoder, the level of quantisation and frame period were set to give an average bit rate of approximately 2400 bps. From the results shown in Table 2, it can be seen that the DRT score for the wideband LPC vocoder exceeds that for the CELP coder.

TABLE 2

| Coder | DRT Score |
|---|---|
| CELP | 83.8 |
| Wideband LPC | 86.8 |

This second embodiment described above incorporates two recent enhancements to LPC vocoders, namely a pulse dispersion filter and adaptive spectral enhancement, but it is emphasised that the embodiments of this invention may incorporate other features from the many enhancements published recently.

What is claimed is:

1. An audio coding system for encoding and decoding an audio signal, said system including an encoder and a decoder, said encoder comprising:

means for decomposing said audio signal into an upper and a lower sub-band signal;

lower sub-band coding means for encoding said lower sub-band signal;

upper sub-band coding means for encoding at least the non-periodic component of said upper sub-band signal according to a source-filter model;

said decoder means comprising means for decoding said encoded lower sub-band signal and said encoded upper sub-band signal, and for reconstructing therefrom an audio output signal, wherein said decoding means comprises filter means and excitation means for generating an excitation signal for being passed by said filter means to produce a synthesised audio signal, said excitation means being operable to generate an excitation signal which includes a substantial component of synthesised noise in an upper frequency band corresponding to the upper sub-band of said audio signal.

2. An audio coding system according to claim 1, wherein said decoder means comprises lower sub-band decoding means and upper sub-band decoding means, for receiving and decoding the encoded lower and upper sub-band signals respectively.

3. An audio coding system according to claim 1, wherein said upper frequency band of said excitation signal substantially wholly comprises a synthesised noise signal.

4. An audio coding system according to claim 1, wherein said excitation signal comprises a mixture of a synthesised noise component and a further component corresponding to one or more harmonics of said lower sub-band audio signal.

5. An audio coding system according to claim 1, wherein said upper sub-band coding means comprises means for analysing and encoding said upper sub-band signal to obtain an upper sub-band energy or gain value and one or more upper sub-band spectral parameters.

6. An audio coding system according to claim 5, wherein said one or more upper sub-band spectral parameters comprise second order LPC coefficients.

7. An audio coding system according to claim 5, wherein said encoder means includes means for measuring the energy in said upper sub-band thereby to deduce said upper sub-band energy or gain value.

8. An audio coding system according to claim 5, wherein said encoder means includes means for measuring the energy of a noise component in said upper band signal thereby to deduce said upper sub-band energy or gain value.

9. An audio coding system according to claim 7, including means for monitoring said energy in said upper sub-band signal, comparing this with a threshold derived from at least one of said upper and lower sub-band energies, and for causing said upper sub-band encoding means to provide a minimum code output if said monitored energy is below said threshold.

10. An audio coding system according to claim 1, wherein said lower sub-band coding means comprises a speech coder, and includes means for providing a voicing decision.

11. An audio coding according to claim 10, wherein said decoder means includes means responsive to the energy in said upper band encoded signal and said voicing decision to adjust the noise energy in said excitation signal dependent on whether the audio signal is voiced or unvoiced.

12. An audio coding system according to claim 1, wherein said lower sub-band coding means comprises an MPEG audio coder.

13. An audio coding system according to claim 1, wherein said upper sub-band contains frequencies above 2.75 kHz and said lower sub-band contains frequencies below 2.75 kHz.

14. An audio coding system according to claim 1, wherein said upper sub-band contains frequencies above 4 kHz, and said lower sub-band contains frequencies below 4 kHz.

15. An audio encoder according to claim 1, wherein said upper sub-band contains frequencies above 5.5 kHz and said lower sub-band contains frequencies below 5.5 kHz.

16. An audio encoder according to claim 1, wherein said upper sub-band coding means encodes said noise component with a bit rate of less than 800 bps and preferably of about 300 bps.

17. An audio coding system according to claim 5, wherein said upper sub-band signal is analysed with relatively long frame periods to determine said spectral parameters and with relatively short frame periods to determine said energy or gain value.

18. An audio coding method for encoding and decoding an audio signal, which method comprises:

decomposing said audio signal into an upper and a lower sub-band signal;

encoding said lower sub-band signal;

encoding at least the non-periodic component of said upper sub-band signal according to a source-filter model, and decoding said encoded lower sub-band signal and said encoded upper sub-band signal to reconstruct an audio output signal;

wherein said decoding step includes providing an excitation signal which includes a substantial component of synthesised noise in an upper frequency bandwidth corresponding to the upper sub-band of said audio signal, and passing said excitation signal through a filter means to produce a synthesised audio signal.

19. An audio decoder for decoding an audio signal encoded by decomposing said audio signal into an upper and a lower sub-band signal, encoding said lower sub-band signal and encoding at least a noise component of said upper sub-band signal according to a source-filter model, said decoder comprising:

filter means and excitation means for generating an excitation signal for being passed by said filter means to produce a synthesised audio signal, said excitation means being operable to generate an excitation signal which includes a substantial component of synthesised noise in an upper frequency band corresponding to the upper sub-bands of said audio signal.

20. A method of decoding an audio signal encoded by decomposing said audio signal into an upper and a lower sub-band signal, encoding said lower sub-band signal and encoding at least a noise component of said upper sub-band signal according to a source-filter model, said method comprising:

providing an excitation signal which includes a substantial component of synthesised noise in an upper frequency bandwidth corresponding to the upper sub-band of the input audio signal, and passing said excitation signal through a filter means to produce a synthesised audio signal.

21. A coder system for encoding and decoding a speech signal, said system comprising encoder means and decoder means, said encoder means including:

filter means for decomposing said speech signal into lower and upper sub-bands together defining a bandwidth of at least 5.5 kHz;

lower sub-band vocoder analysis means for performing a relatively high order vocoder analysis on said lower sub-band to obtain vocoder coefficients including LPC coefficients representative of said lower sub-band;

upper sub-band vocoder analysis means for performing a relatively low order vocoder analysis on said upper sub-band to obtain vocoder coefficients including LPC coefficients representative of said upper sub-band;

coding means for coding vocoder parameters including said lower and upper sub-band coefficients to provide an encoded signal for storage and/or transmission, and said decoder means including:

decoding means for decoding said encoded signal to obtain vocoder parameters including said lower and upper sub-band vocoder coefficients;

synthesising means for constructing an LPC filter from the vocoder parameters from said upper and lower sub-bands and for synthesising said speech signal from said filter and from an excitation signal.

22. A voice coder system according to claim 21, wherein said lower sub-band vocoder analysis means and said upper sub-band vocoder analysis means are LPC vocoder analysis means.

23. A voice coder system according to claim 22, wherein said lower sub-band LPC analysis means performs a tenth order or higher analysis.

24. A voice coder system according to claim 22, wherein said high band LPC analysis means performs a second order analysis.

25. A voice coder system according to claim 21, wherein said synthesising means includes means for re-synthesising said lower sub-band and said upper sub-band and for combining said re-synthesised lower and higher sub-bands.

26. A voice coder system according to claim 25, wherein said synthesising means includes means for determining the power spectral densities of the lower sub band and the upper sub-band respectively, and means for combining said power spectral densities to obtain a relatively high order LPC model.

27. A voice coder system according to claim 26, wherein said means for combining includes means for determining the autocorrelations of said combined power spectral densities.

28. A voice coder system according to claim 27, wherein said means for combining includes means for determining the autocorrelations of the power spectral density functions of said lower and upper sub-bands respectively, and then combining said autocorrelations.

29. A voice encoder apparatus for encoding a speech signal, said encoder apparatus including:

filter means for decomposing said speech signal into lower and upper sub-bands;

low band vocoder analysis means for performing a relatively high order vocoder analysis on said lower sub-band signal to obtain vocoder coefficients representative of said lower sub-band;

upper band vocoder analysis means for performing a relatively low order vocoder analysis on said upper sub-band signal to obtain vocoder coefficients representative of said upper sub-band, and coding means for coding said low and high sub band vocoder coefficients to provide an encoded signal for storage and/or transmission.

30. A voice decoder apparatus for synthesising a speech signal coded by a coder in accordance with claim 29, and said coded speech signal comprising parameters including LPC coefficients for a lower sub-band and an upper sub-band, said decoder apparatus including:

decoding means for decoding said encoded signal to obtain LPC parameters including said lower and upper sub-band LPC coefficients, and synthesising means for constructing an LPC filter from the vocoder parameters for said upper and said lower sub-bands and for synthesising said speech signal from said filter and from an excitation signal.

31. An audio coding system according to claim 2, wherein said upper frequency band of said excitation signal substantially wholly comprises a synthesised noise signal.

32. An audio coding system according to claim 2, wherein said excitation signal comprises a mixture of a synthesised noise component and a further component corresponding to one or more harmonics of said lower sub-band audio signal.

33. An audio coding system according to claim 6, wherein said encoder means includes means for measuring the energy in said upper sub-band thereby to deduce said upper sub-band energy or gain value.

34. An audio coding system according to claim 6, wherein said encoder means includes means for measuring the energy of a noise component in said upper band signal thereby to deduce said upper sub-band energy or gain value.

35. An audio coding system according to claim 8, including means for monitoring said energy in said upper sub-band signal, comparing this with a threshold derived from at least one of said upper and lower sub-band energies, and for causing said upper sub-band encoding means to provide a minimum code output if said monitored energy is below said threshold.

36. A voice coder system according to claim 23, wherein said high band LPC analysis means performs a second order analysis.

* * * * *